United States Patent [19]

Takenaga et al.

[11] 4,030,445

[45] June 21, 1977

[54] MULTICOLOR DEVELOPING DEVICE

[75] Inventors: Hisayoshi Takenaga; Teruo Yotsukura, both of Hitachi, Japan

[73] Assignee: Hitachi, Ltd., Japan

[22] Filed: Feb. 26, 1976

[21] Appl. No.: 661,794

[30] Foreign Application Priority Data

Feb. 28, 1975 Japan ..... 50-26564

[52] U.S. Cl. ..... 118/645; 355/4

[51] Int. Cl.[2] ..... G03G 15/08

[58] Field of Search ..... 118/637, 645, 653, 658; 427/18; 355/4

[56] References Cited

UNITED STATES PATENTS

| | | | |
|---|---|---|---|
| 3,574,455 | 4/1971 | Mix et al. | 355/4 |
| 3,608,522 | 9/1971 | Davidson | 118/637 |
| 3,682,678 | 8/1972 | Moradzaden et al. | 118/637 |
| 3,709,594 | 1/1973 | Hastwell | 355/4 |
| 3,795,917 | 3/1974 | Yamaji et al. | 355/4 |

FOREIGN PATENTS OR APPLICATIONS

| | | | |
|---|---|---|---|
| 1,293,482 | 10/1972 | United Kingdom | 355/4 |

*Primary Examiner*—Henry S. Jaudon

*Attorney, Agent, or Firm*—Craig & Antonelli

[57] ABSTRACT

A multicolor developing device having a plurality of developing units interposed between a pair of rotary plates and disposed radially equidistantly relative to the axis of the rotation of the rotary plates, said each developing unit having a magnetic roller rotatably supported by a non-magnetic sleeve for carrying magnetic developing particles along the outer periphery of the non-magnetic sleeve by means of the magnetic forces developed by the magnetic roller so as to cause the particles to adhere to an electrostatic latent image to thereby develop the same into a visible image, and wherein the rotation of the rotary plates causes any one of developing units to register in facing relation with the electrostatic latent image.

8 Claims, 3 Drawing Figures

MULTICOLOR DEVELOPING DEVICE

BACKGROUND OF THE INVENTION

1. Field of the Invention

This invention relates to a multicolor developing devices, and, more particularly, to multicolor developing devices of the type in which magnetic developing particles retained by magnetic forces are caused to adhere to an electrostatic latent image to thereby develop the same into a visible image in multicolor.

2. Description of the Prior Art

A developing unit of the type in which a magnetic roller is rotatably supported within a non-magnetic sleeve and magnetic developing particles are carried along the outer periphery of the sleeve by the magnetic forces produced by the magnetic roller to be adhered to an electrostatic latent image formed on a recording sheet is disclosed in U.S. Pat. No. 3,455,276 granted to Glenn R. Anderson July 15, 1969 (Assignee, Minnesota Mining and Manufacturing Company; Filed, May 23, 1967, Ser. No. 640,720). A plurality of such developing units will be required if in a copying machine it is desired to develop an electrostatic latent image in multicolor or in any desired color. Such a copying machine will be constructed such that one of the developing units developers containing developing particles of any desired color therein is brought to the developing position to perform developing.

In the meantime it is desirable that the respective developing units be arranged in equidistant spaced relation with the electrostatic latent image forming station and the developing station. The reason for this is that it is preferable to keep constant the time required for conveying a recording sheet to the developing station after the formation of electrostatic latent images to thereby make the amount of leakage of the static charge equal for all the colors. Also, when a plurality of developing units are used, it is essential to make a developing apparatus compact in size by reasonably arranging the developing units.

SUMMARY OF THE INVENTION

It is an object of the present invention to provide a compact developing device having a plurality of developing units mounted therein.

It is another object of the present invention to provide a developing device in which a single drive motor can be commonly used for controlling the operation of a plurality of developing units.

It is still another object of the present invention to provide a developing device in which any one of the plurality of developing units can be moved to a predetermined developing station.

Other objects and features of the present invention will become apparent from the detailed description of a preferred embodiment thereof with reference to the accompanying drawings.

The outstanding feature of the present invention resides in that a power transmitting gear unit is provided in meshing engagement with gears each mounted on rotatable shafts of a plurality of developing units so that developing particles can be conveyed and rotation of the power transmitting gear unit can be transmitted to the developing units to move any desired developing unit to the developing station. BRIEF DESCRIPTION OF THE DRAWINGS FIG. 1 is a vertical sectional view showing essential portions of one embodiment of the developing device in accordance with the present invention;

DESCRIPTION OF THE PREFERRED EMBODIMENT

Figure 1:
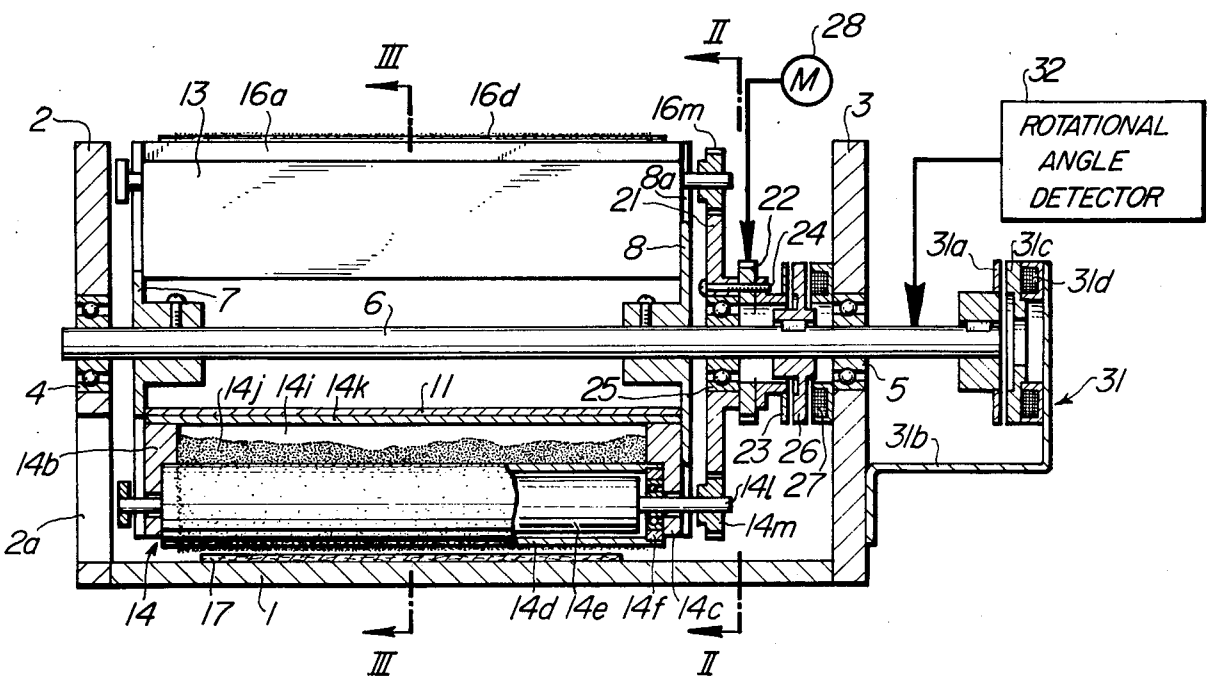
Figure 3:
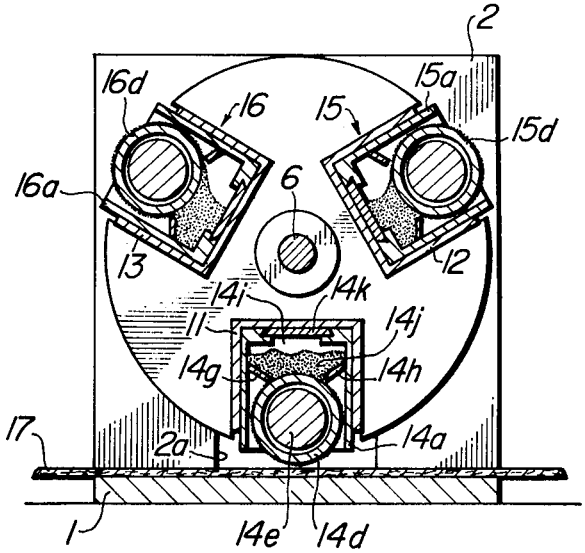
FIG. 3 is a sectional view taken along the line III—III of FIG. 1.

Referring to FIG. 1, designated by the reference numeral 1 is a base plate which has two side plates 2 and 3 attached thereto and disposed at opposite ends thereof. The side plates 2 and 3 have mounted therein ball bearings 4 and 5 respectively for rotatably supporting a shaft 6. Designated by the reference numerals 7 and 8 are support members each of which includes a boss for securing each support member to the shaft 6 and a flange. Arranged between the flanges of the two support members 7 and 8 are channel-shaped rails 11, 12 and 13 for supporting developing units 14, 15 and 16 respectively thereon. As shown in FIG. 3, the guide rails 11, 12 and 13 are disposed radially equidistantly with respect to the axis of the shaft 6 and spaced apart from one another by 120°. As the three developing units 14, 15 and 16 are identical in construction, the explanation will hereinafter be given for one developing unit 14.

The developing unit 14 comprises a case 14*a* slidably received in the guide rail 11 along the inner surfaces of the guide rail 11. The case 14*a* is defined at opposite ends thereof by end plates 14*b* and 14*c* to provide a developing box as shown in FIG. 1. The developing box is open at one side thereof, and a non-magnetic sleeve 14*d* of a hollow cylindrical shape is attached to the end plates 14*b* and 14*c* in such a manner that the sleeve 14 partly protrudes beyond the open side of the developing box. A magnetic roller 14*e* is rotatably journaled by a pair of ball bearings 14*f* within the sleeve 14*d*. Guide plates 14*g* and 14*h* extend from the opposite inner side surfaces of the case 14*a* toward the sleeve 14*d* and are spaced apart at their forward ends from the outer periphery of the sleeve 14*d* with a very small clearance existing therebetween. The guide plates 14*g* and 14*h* and the case 14*a* define a space or a compartment 14*i* for containing developing particles 14*j*. A cover 14*k* is detachably attached to the case 14*a* to cover an opening through which developing particles 14*j* can be fed to the storing compartment 14*i*.

The magnetic roller 14*e* is securely supported by a shaft 14*l* which extends at one end portion thereof outside the support member 8, and a gear 14*m* is mounted on the one end portion of the shaft 14*l*. There is formed an access opening 2*a* in the side plate 2 for allowing the developing unit 14 to be inserted therethrough along the guide rail 11 as shown in FIG. 1. The flange of the support member 8 is formed therein with a cutout 8*a* to permit the gear 14*m* to pass therethrough. In the drawings, the developing unit 14 is shown in the developing station in which the developing particles 14*j* carried along the outer periphery of the sleeve 14*d* by the magnetic forces form a tuft which is brought into sweeping engagement with a recording sheet 17 to effect developing of a latent image formed on the recording sheet 17. It is to be understood that other developing units 15 and 16 are identical in construction with the unit 14, the only difference residing in that the developing particles stored therein differ from one another in color.

Figure 2:
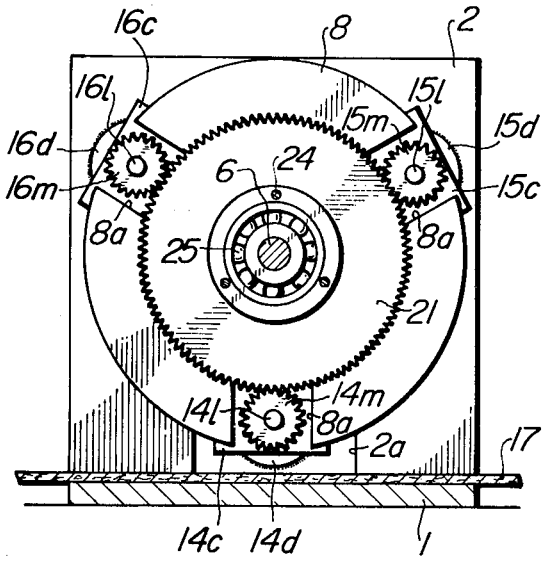
FIG. 2 is a sectional view taken along the line II—II of FIG. 1.

A drive mechanism will now be described. In FIGS. 1 and 2, the drive gear mechanism comprises an output gear 21, an input gear 22 and a drive-side clutch disk 23, all of which are connected together as by rivets or screws 24. The output gear 21 is rotatably mounted on the shaft 6 by means of a ball bearing 25, and is maintained in meshing engagement with gears 14*m*, 15*m* and 16*m* of the respective developing units 14, 15 and 16. A driven-side clutch disk 26 is keyed to the shaft 6 so that it can rotate integrally with the latter. The friction engaging surface of the disk 26 faces the disk 23. An actuating magnet 27 includes a magnetic path and a winding which are positioned on the opposite side of the friction engaging surface of the driven-side clutch plate 26 and attached to the side plate 3 so that it is disposed concentrically with the shaft 6.

Upon energizing the winding of the actuating magnet 27, the driven-side clutch disk 26 is magnetized by the magnetic path of the magnet 27 and attracts the drive-side clutch disk 23 into engagement therewith. Thus the rotational force of the input gear 22 is transmitted to the shaft 6. To this end the clutch disk 23 preferably includes friction member supported for axial movement and a magnetic member for producing an axially biasing force by magnetic forces. The input gear 22 is driven by the motor 28 through a gearing (not shown).

Braking means designated by the reference numeral 31 comprises a rotary disk 31*a* keyed to the shaft 6, a stationary magnetic disk 31*c* supported through a holder 31*b* by the side plate 3, and an electromagnet 31*d* mounted in the stationary magnetic disk 31*c*. When energized, the electromagnet 31*d* causes the rotary disk 31*a* to be attracted into engagement with the fixed disk 31*c* to thereby apply the brake to the shaft 6. Designated by the reference numeral 32 is a rotational angle detector for detecting the positions of the developing units 14, 15 and 16. Detailed explanation of the construction of the detector 23 is omitted, it being apparent to those skilled in the art that the use of a cam and the like readily enables them to provide the detector of the type described.

In operation of the device described above, the movement of developing units 14, 15 and 16 to the developing station will now be described. First of all, the rotary disk 31*a* of the braking means 31 is released to make the shaft 6 freely rotatable. Then, a current is passed to the winding of the actuating magnet 27 to attract the drive-side clutch disk 23 into engagement with the driven-side clutch disk 26 so as to transmit drive power from the motor 28 to the shaft 6. This causes the support members 7 and 8 to rotate together with the shaft 6, so that the developing units 14, 15 and 16 can rotate about the axis of the shaft 6. In the drawings, the developing unit 14 is shown in the developing station. If it is desired to perform developing in the color of the developing particles contained in the unit 15, then the shaft 6 is rotated till the unit 15 is brought to the developing station. The rotational angle detector 32 detects when the unit 15 reaches the developing station, and deenergizes the actuating magnet 27 to release the drive-side clutch disk 23 from engagement with the driven-side clutch disk 26 to cut off transmission of the rotational force to the shaft 6. At the same time, the electromagnet 31 is excited to attract the rotary disk 31*a* into engagement with the fixed disk 31*c*, thereby braking the shaft 6. Upon continuation of the attraction of the disk 31*a*, the unit 15 is maintained in the developing station.

Description will now be given of rotation of the magnetic roller 14*e* of the unit 14 (15, 16). Assuming that the unit 14 is held in the developing station, rotation of the motor 28 will be transmitted through the gears 22, 21 and 14*m* to the shaft 14*l* supporting the roller 14*e*. Thus the roller 14*e* is rotated, and the magnetic forces of the roller 14*e* causes the developing particles 14*j* adhering to the outer periphery of the sleeve 14*d* to move along the outer periphery of the sleeve in a direction opposite to the direction of rotation of the roller 14*e*. Thus, the developing particles 14*j* forming a tuft adapted to be in contact with the recording shaft 17 are replenished with fresh developing particles, thereby preventing the lowering of the developing ability due to consumption of the coloring particles.

As seen from the embodiment of the developing device in accordance with the present invention, all the parts of the device are reasonably arranged to make the entire construction of the device compact in size. In addition, as rotation of the magnetic roller of each developing unit and the selective movement of the respective units to the developing station can be controlled by means of a single electric motor it is possible to reduce production cost. The fact that there is only one developing station for all the developing units permits the developing characteristics in the respective developing units to coincide with one another. This contributes to improved quality of the developed color image.

The invention has been described with reference to an embodiment in which the magnetic roller of each developing unit is caused to rotate. It is to be understood, however, that the sleeve of each developing unit can be made to rotate while rendering the magnetic roller stationary without departing from the spirit and scope of the invention. It will also be apparent to those skilled in the art that the number of the developing units can be increased or decreased as desired within the scope of the invention.

We claim:

1. A multicolor developing device comprising:

a rotary shaft;

a plurality of developing units each including a magnetic roller and a sleeve and adapted to carry developing particles along the outer periphery of the sleeve, said magnetic roller and sleeve being rotatable relative to each other;

support means for supporting said developing units about the rotary shaft such that said developing units are located radially equidistantly with respect to the axis of rotation of said rotary shaft and are spaced a predetermined distance apart from one another;

a drive gear mechanism comprising a first gear mounted coaxially on the rotary shaft by means of a bearing and adapted to engage in driving relation with either the magnetic roller or the sleeve of the respective developing units, and a clutch adapted to lock the first gear with respect to said rotary shaft; and braking means for stopping the rotation of said rotary shaft.

2. A multicolor developing surface as claimed in claim 1, wherein said each developing unit is axially slidably received in said support means.

3. A multicolor developing device comprising:

a rotary shaft;

a plurality of developing units each including a magnetic roller, a sleeve and a second gear connected to either the magnetic roller or the sleeve and projecting sideward, each developing unit being adapted to carry developing particles along the outer periphery of the sleeve, said magnetic roller and sleeve being rotatable relative to each other;

support means for supporting said developing units about the rotary shaft such that said developing units are located radially equidistantly with respect to the axis of rotation of said rotary shaft and are spaced a predetermined distance apart from one another;

a drive gear mechanism comprising a first gear mounted rotatably on the rotary shaft and adapted to engage, at its outer periphery, the second gears of the respective developing units, and a clutch mounted coaxially on the rotary shaft and adapted to lock the movement of the first gear relative to the rotary shaft; and braking means for stopping the rotation of the rotary shaft.

4. A multicolor developing device as in claim 3, wherein said rotary shaft is supported on two side plates which are provided in spaced relation to each other, said support means supports the respective developing units about the rotary shaft between the side plates, and wherein said drive gear mechanism is coaxially mounted on the rotary shaft between one of the side plates and the developing units.

5. A multicolor developing device comprising:

a rotary shaft;

means for supporting said rotary shaft for rotation about its axis;

a developing unit support structure affixed to said rotary shaft so as to be rotatable in accordance with the rotation of said rotary shaft;

a plurality of developing units supported by said support structure at equal radial distances about the axis of said rotary shaft and spaced a predetermined distance apart from each other, each developing unit including a magnetic roller and sleeve and adapted to carry developing particles along the outer periphery of the sleeve, said magnetic roller and sleeve being rotatable relative to each other about an axis parallel to the axis of said rotary shaft; and means, mounted on said rotary shaft, for selectively rotating said rotary shaft and said developing unit support structure affixed thereto and for selectively rotating the magnetic rollers relative to the sleeves of the respective developing units independently of the rotational position of said rotary shaft.

6. A multicolor developing device according to claim 5, wherein said means comprises a driven first gear mounted for rotation about said rotary shaft, and a clutch mechanism mounted on said rotary shaft for coupling said driven first gear to said shaft in a first position of said clutch, whereby said rotary shaft rotates with the rotation of said first driven gear, and for decoupling said driven first gear from said shaft in a second position of said clutch, whereby said driven first gear rotates about said rotary shaft.

7. A multicolor developing device according to claim 6, wherein said means further includes respective second gears coupled to each developing unit and engaging said driven first gear for rotating the magnetic rollers relative to their associated sleeves in said developing units upon rotation of said driven first gear.

8. A multicolor developing device according to claim 7, further comprising braking means for selectively stopping the rotation of said rotary shaft.

* * * * *